US008733573B2

(12) United States Patent
Lucht

(10) Patent No.: US 8,733,573 B2
(45) Date of Patent: May 27, 2014

(54) RECEPTACLE FORMED OF A FOLDED SHEET METAL BLANK

(71) Applicant: Duane Lucht, Winnipeg (CA)

(72) Inventor: Duane Lucht, Winnipeg (CA)

( * ) Notice: Subject to any disclaimer, the term of this patent is extended or adjusted under 35 U.S.C. 154(b) by 0 days.

(21) Appl. No.: 13/627,531

(22) Filed: Sep. 26, 2012

(65) Prior Publication Data

US 2014/0084000 A1 Mar. 27, 2014

(51) Int. Cl.
*B65D 6/00* (2006.01)
*B65D 25/00* (2006.01)

(52) U.S. Cl.
USPC ..... 220/62.1; 220/6; 220/62

(58) Field of Classification Search
USPC ..... 220/6, 62, 62.1
See application file for complete search history.

(56) References Cited

U.S. PATENT DOCUMENTS 153,932 A 8/1874 Bushfield
163,088 A 5/1875 Martyn
2,916,181 A * 12/1959 Pfister et al. ..... 220/62
5,195,644 A * 3/1993 Schmid ..... 220/6
5,344,004 A * 9/1994 Meyer ..... 206/45.25
6,918,503 B1 * 7/2005 Molander ..... 220/62
2006/0277965 A1 * 12/2006 Durney ..... 72/379.2
2008/0098787 A1 * 5/2008 Durney et al. ..... 72/324

* cited by examiner

*Primary Examiner* — Anthony Stashick
*Assistant Examiner* — Madison L Poos
(74) *Attorney, Agent, or Firm* — Ryan W. Dupui; Kyle R. Satterthwaite; Ade & Company Inc.

(57) ABSTRACT

A receptacle is formed by folding a single sheet metal blank to define a floor, a front wall, a rear wall, and two side walls. The walls are joined to one another at each corner of two adjacent walls by providing a mounting tab foldable relative to one of the wall and a tongue on the other wall to receive and retain the mounting tab by interlocking connection of mating connections. Apertures for hooking the receptacle on a wall are located in the rear wall in alignment with corresponding apertures in the mounting tabs at the rear for increased strength. Each mounting tab includes a first portion which interlocks with the tongue and a second portion which is considerably longer than the first portion to redirect forces which might otherwise tend to urge the tongues to release the mounting tabs therefrom.

8 Claims, 8 Drawing Sheets

RECEPTACLE FORMED OF A FOLDED SHEET METAL BLANK

FIELD OF THE INVENTION

The present invention relates to a receptacle formed by folding a sheet metal blank, and more particularly the present invention relates to a sheet metal blank including interlocking connectors and perforated lines of weakness permitting assembly into a receptacle without additional tools or fasteners being required.

BACKGROUND

Boxes, trays and receptacles formed of sheet metal are known in various forms for a variety of storage purposes. U.S. Pat. No. 163,088 by Martyn and U.S. Pat. No. 153,032 by Bushfield disclose two examples of receptacles formed from a single flat blank of sheet metal by incorporating multiple folds into each corner of the receptacle being formed. The significant amount of folds cannot be accomplished without tools. Furthermore, no fastening is provided to retain the receptacle in the folded condition such that the receptacle can come apart in time.

Current examples of receptacles formed from a single folded blank of sheet metal typically rely on the use of additional rivets to retain in place. The riveting cannot be readily accomplished at a consumer level and thus receptacle must be shipped to consumers in an assembled state rather than as a flat blank which would reduce shipping cost and inventory space requirements for distributors.

In some instances, sheet metal receptacles are provided which can be supported on hanging elements on an upright supporting surface, for example hooks retained on an upright peg board. In these instances, rivets are generally required to provide sufficient strength to prevent the receptacle from coming apart when receiving a load therein, however the rivets again require the receptacle to be shipped to the consumer in an already assembled state.

SUMMARY OF THE INVENTION

In a preferred embodiment, the present invention provides a receptacle formed of a sheet metal blank which can be assembled by a consumer with little or no tool requirements and which can be assembled in a manner which is sufficiently durable to support a load therein when hung on hanging elements on an upright supporting surface without additional fasteners being required.

According to one aspect of the invention there is provided a sheet metal blank arranged to form a receptacle for securement to a pair hanging elements on an upright supporting surface, the sheet metal blank comprising:

a floor panel portion arranged to define a floor of the receptacle and including a front edge, a rear edge, and two side edges extending along opposing sides of the floor panel portion between the front and rear edges;

a front panel portion integrally joined along the front edge of the floor panel portion so as to be foldable relative to the floor panel portion and as so as to define an upright front wall of the receptacle;

a rear panel portion integrally joined at an inner edge along the rear edge of the floor panel portion so as to be foldable relative to the floor panel portion and so as to define an upright rear wall of the receptacle;

a pair of side panel portions integrally joined along the side edges of the floor panel portion respectively so as to be foldable relative to the floor panel portion and so as to define respective upright side walls of the receptacle;

a pair of front interlocking connections arranged to connect opposing sides of the front panel portion to respective ones of the side panel portions, each front interlocking connection comprising:

- a first front connector integrally formed on one of the front panel portion or the respective side panel portion; and
- a front mounting tab integrally joined to the other one of the front panel portion or the respective side panel portion so as to be foldable in relation thereto; and
- a second front connector formed on the front mounting tab which is arranged to matingly connect with the first front connector such that the respective side panel portion is joined to the front panel portion solely by mating connection of the first and second front connectors;

a pair of rear interlocking connections arranged to connect opposing sides of the rear panel portion to respective ones of the side panel portions, each rear interlocking connection comprising:

- a first rear connector integrally formed on the rear panel portion;
- a rear mounting tab integrally joined to the respective side panel portion so as to be foldable in relation thereto; and
- a second rear connector formed on the rear mounting tab which is arranged to matingly connect with the first rear connector such that the respective side panel portion is joined to the rear panel portion solely by mating connection of the first and second rear connectors;

an auxiliary mounting aperture formed in each rear mounting tab; and a pair of rear mounting apertures formed in the rear panel portion adjacent an outer edge opposite from the inner edge such that:

- the rear mounting apertures are aligned with respective ones of the auxiliary mounting apertures in the rear mounting tabs;
- the rear mounting apertures are spaced apart from the first and second rear connectors of the respective rear interlocking connection; and
- each rear mounting aperture and the auxiliary mounting aperture aligned therewith are arranged to receive a respective one of the hanging elements therethrough.

By aligning apertures in the rear panel portion and the rear mounting tab the receptacle is well suited to be hung on an upright supporting surface even when the receptacle is assembled without rivets or fasteners. Any load in the receptacle is transferred through the side panels and to the rear mounting tabs in addition to be carried on the rear panel portion so that an interlock type connection of the side panel portions and rear panel portion provides sufficient strength when the receptacle is assembled by a consumer without the use of fastening tools.

Each front interlocking connection may further comprise a front mounting tongue integrally formed on one of the front panel portion or the respective side panel portion such that the first front connector is formed on the front mounting tongue and such that a portion of the front mounting tab is arranged to be received between the front mounting tongue and the panel portion upon which the front mounting tongue is integrally formed when the first and second front connectors are mated.

Similarly, each rear interlocking connection may further comprise a rear mounting tongue integrally formed on one of the rear panel portion or the respective side panel portion such that the first rear connector is formed on the rear mounting tongue and such that a portion of the rear mounting tab is arranged to be received between the rear mounting tongue and the panel portion upon which the rear mounting tongue is integrally formed when the first and second rear connectors are mated.

When the front panel portion, the rear panel portion and the side panel portions are each joined to the floor panel portion along a respective primary folding line of weakness in the sheet metal blank and each mounting tab is joined to the respective panel portion along a respective secondary folding line of weakness in the sheet metal blank, preferably each of the primary and second folding lines of weakness comprises a row of perforations in the sheet metal blank.

Each front mounting tab may further comprise a first portion protruding from the inner edge to a first outer edge which locates the second front connector therein, and a second portion in rigid coplanar relationship with the first portion which protrudes from the inner edge to a second outer edge which is spaced from the inner edge by a greater distance than the first outer edge.

Similarly, each rear mounting tab may further comprise a first portion protruding from the inner edge to a first outer edge which locates the second rear connector therein, and a second portion in rigid coplanar relationship with the first portion which protrudes from the inner edge to a second outer edge which is spaced from the inner edge by a greater distance than the first outer edge.

Each mounting tab may be formed such that the second portion is farther from the floor panel portion than the respective first portion so as to be located above the first portion.

In some instances the receptacle may be used in combination with the hanging elements in which each hanging element comprises a hook member protruding outwardly and upwardly from the upright supporting surface so as to be received through a respective one of the rear mounting apertures and retain the receptacle thereon. Alternatively each hanging element may comprise a fastener received through a respective one of the rear mounting apertures and fastened to the upright supporting surface so as to retain the receptacle thereon.

According to a second aspect of the present invention there is provided a sheet metal blank arranged to form a receptacle, the sheet metal blank comprising:

a floor panel portion arranged to define a floor of the receptacle and includes a front edge, a rear edge, and two side edges extending along opposing sides of the floor panel portion between the front and rear edges;

a front panel portion integrally joined along the front edge of the floor panel portion so as to be foldable relative to the floor panel portion and as so as to define an upright front wall of the receptacle;

a rear panel portion integrally joined at an inner edge along the rear edge of the floor panel portion so as to be foldable relative to the floor panel portion and so as to define an upright rear wall of the receptacle;

a pair of side panel portions integrally joined along the side edges of the floor panel portion respectively so as to be foldable relative to the floor panel portion and so as to define respective upright side walls of the receptacle;

a pair of front interlocking connections arranged to connect opposing sides of the front panel portion to respective ones of the side panel portions, each front interlocking connection comprising:

- a front mounting tongue integrally formed on one of the front panel portion or the respective side panel portion;
- a first front connector formed on the front mounting tongue;
- a front mounting tab integrally joined at an inner edge to the other one of the front panel portion or the respective side panel portion so as to be foldable in relation thereto, the front mounting tab including:
  - a first portion protruding from the inner edge to a first outer edge arranged to be received between the front mounting tongue and the panel portion upon which the front mounting tongue is integrally formed; and
  - a second portion in rigid coplanar relationship with the first portion which protrudes from the inner edge to a second outer edge which is spaced from the inner edge by a greater distance than the first outer edge;
- a second front connector formed on the first portion of the front mounting tab which is arranged to matingly connect with the first front connector such that the respective side panel portion is joined to the front panel portion solely by mating connection of the first and second front connectors; and a pair of rear interlocking connections arranged to connect opposing sides of the rear panel portion to respective ones of the side panel portions, each rear interlocking connection comprising:

- a rear mounting tongue integrally formed on one of the rear panel portion or the respective side panel portion;
- a first rear connector formed on the rear mounting tongue;
- a rear mounting tab integrally joined at an inner edge to the other one of the front panel portion or the respective side panel portion so as to be foldable in relation thereto, the rear mounting tab including:
  - a first portion protruding from the inner edge to a first outer edge arranged to be received between the rear mounting tongue and the panel portion upon which the rear mounting tongue is integrally formed; and
  - a second portion in rigid coplanar relationship with the first portion which protrudes from the inner edge to a second outer edge which is spaced from the inner edge by a greater distance than the first outer edge; and
- a second rear connector formed on the first portion of the rear mounting tab which is arranged to matingly connect with the first rear connector such that the respective side panel portion is joined to the rear panel portion solely by mating connection of the first and second rear connectors.

The second portion of each mounting tab serves to reinforce the interlocking connections. When no additional second portion is provided, outward loads applied to the upright walls of the receptacle cause the mounting tabs to apply a moment force to the mounting tongues to unfold them from the plane of the respective panel resulting in the interlocking connection being more readily released. The second portions of the mounting tabs which are twice the length of the first portions instead serve to relocate the center of the moment force away from the folded connection of the mounting tongue to the respective panel. Accordingly outward forces on the upright walls tend not to cause the tongues to unfold, thus considerably strengthening the interlocking connections.

Preferably each mounting tab is formed such that the second portion is farther from the floor panel portion than the respective first portion so as to be located above the first portion.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
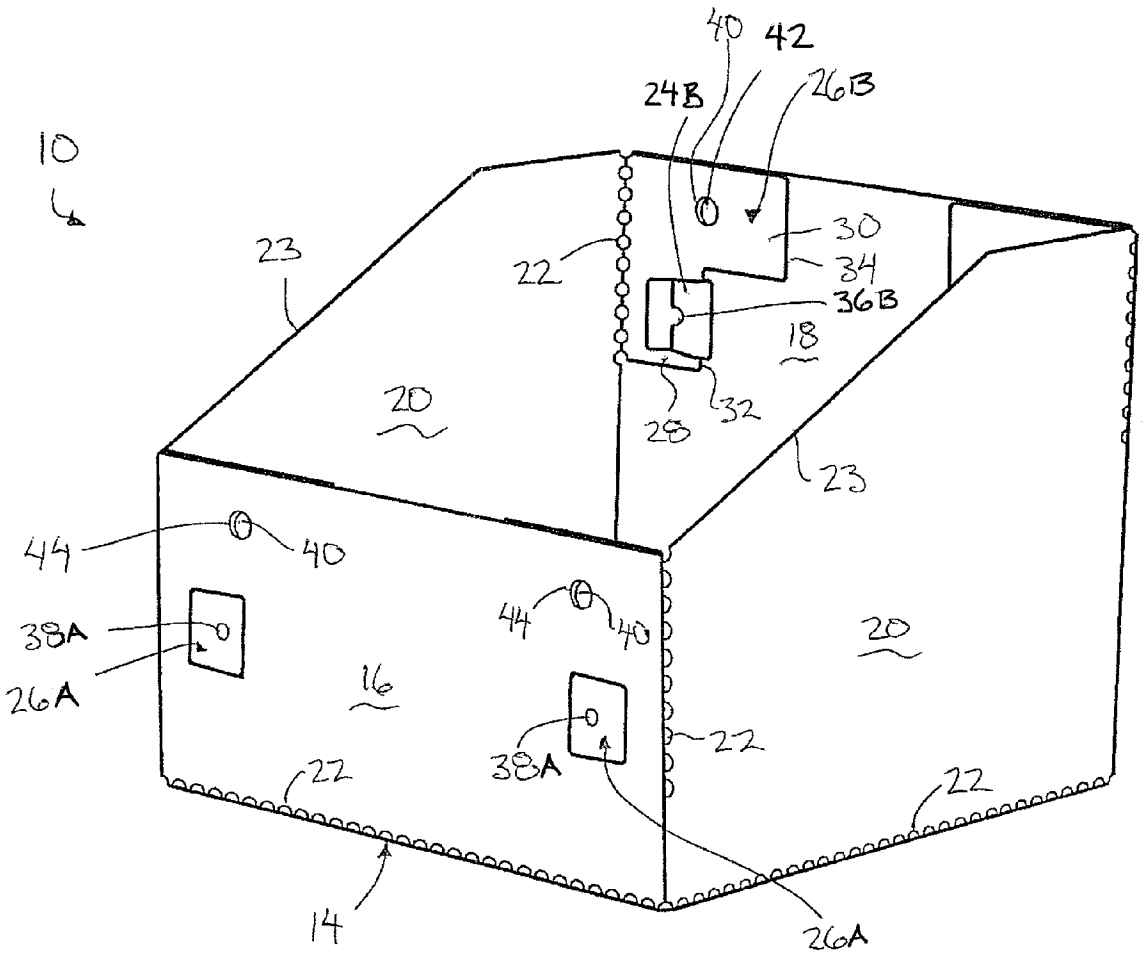
FIG. 1 is a perspective view of the sheet metal receptacle according to the present invention.
Figure 2:
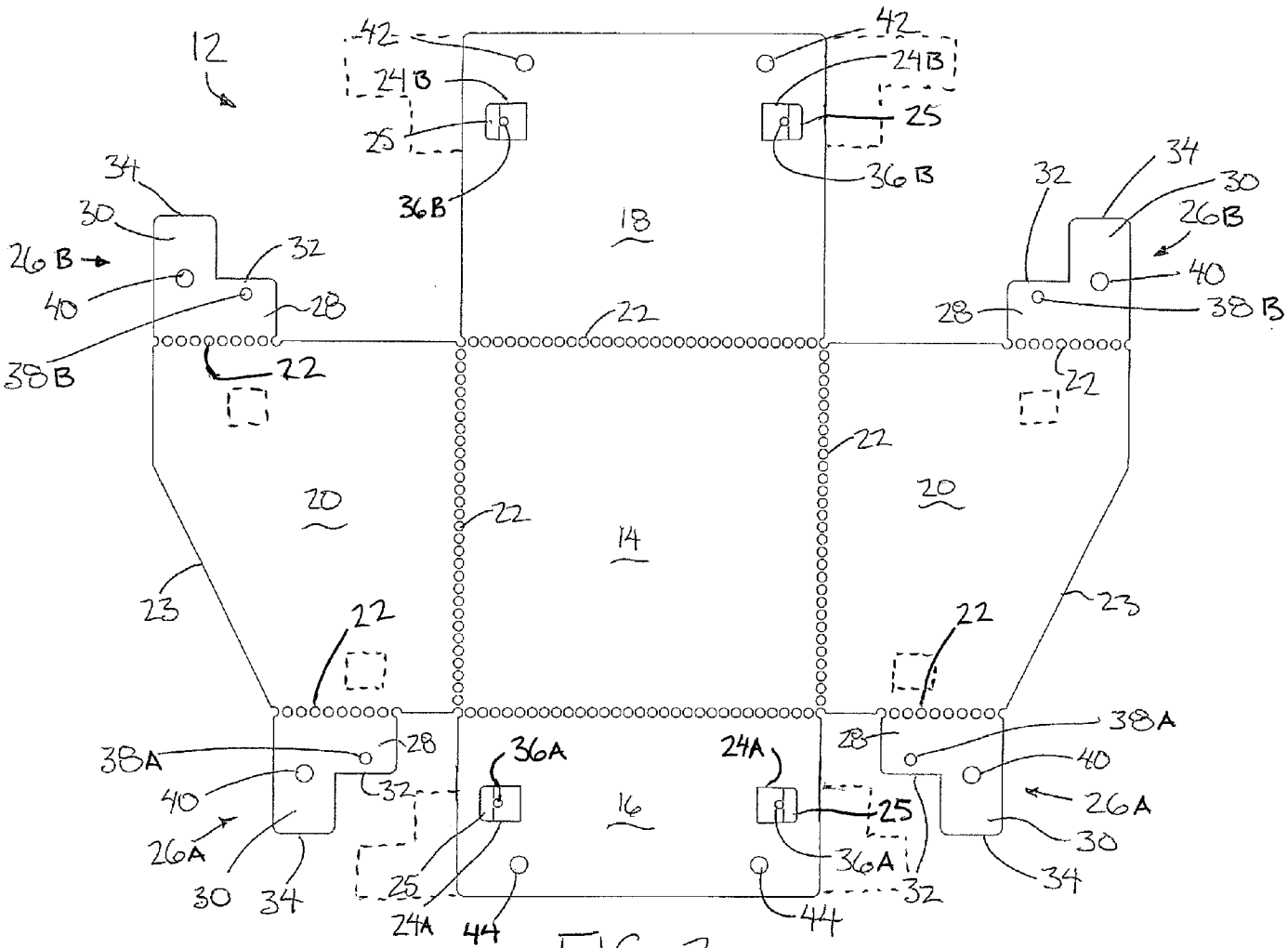
FIG. 2 is a plan view of a sheet metal blank for forming the receptacle according to FIG. 1.
Figure 3:
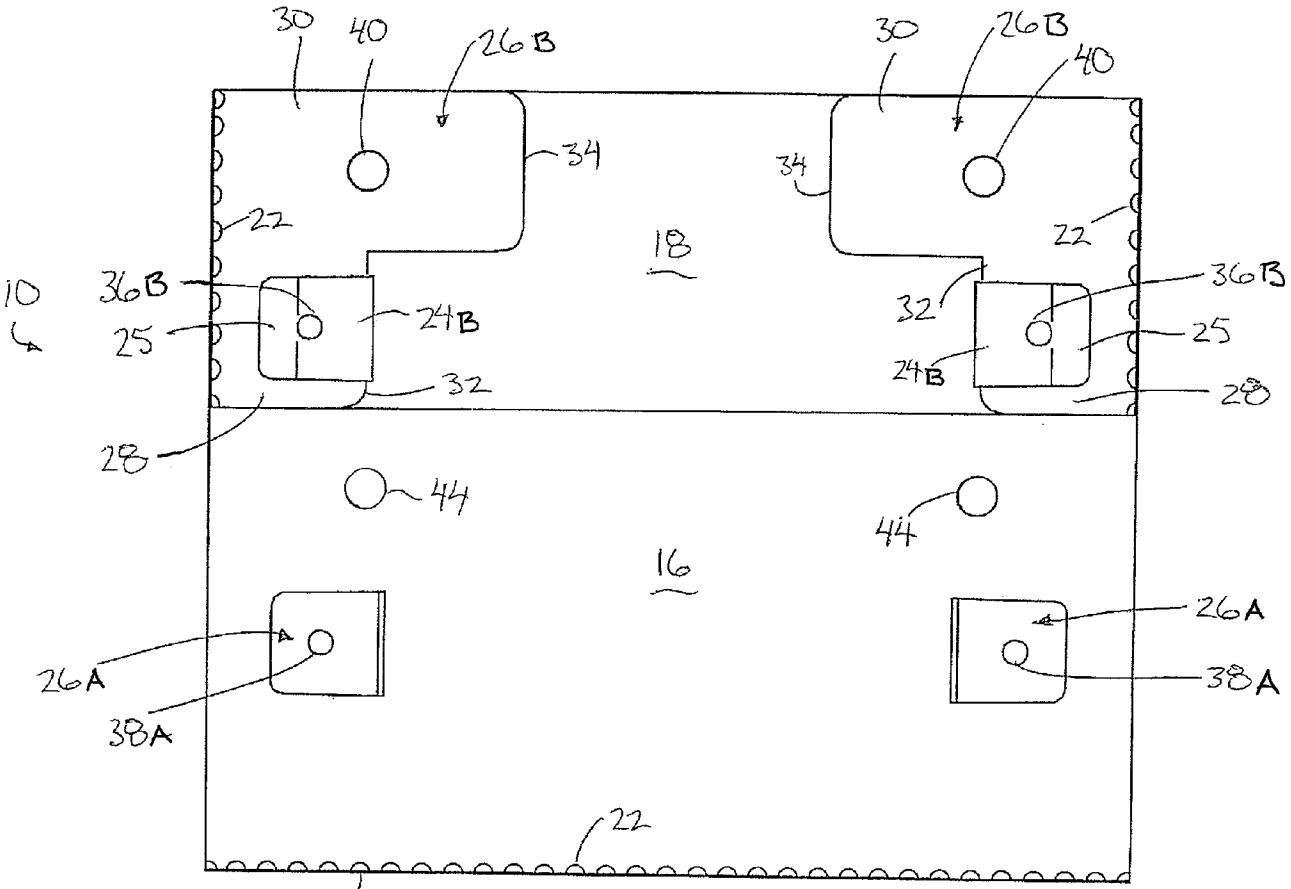
FIG. 3 is a front elevational view of the sheet metal receptacle.
Figure 4:
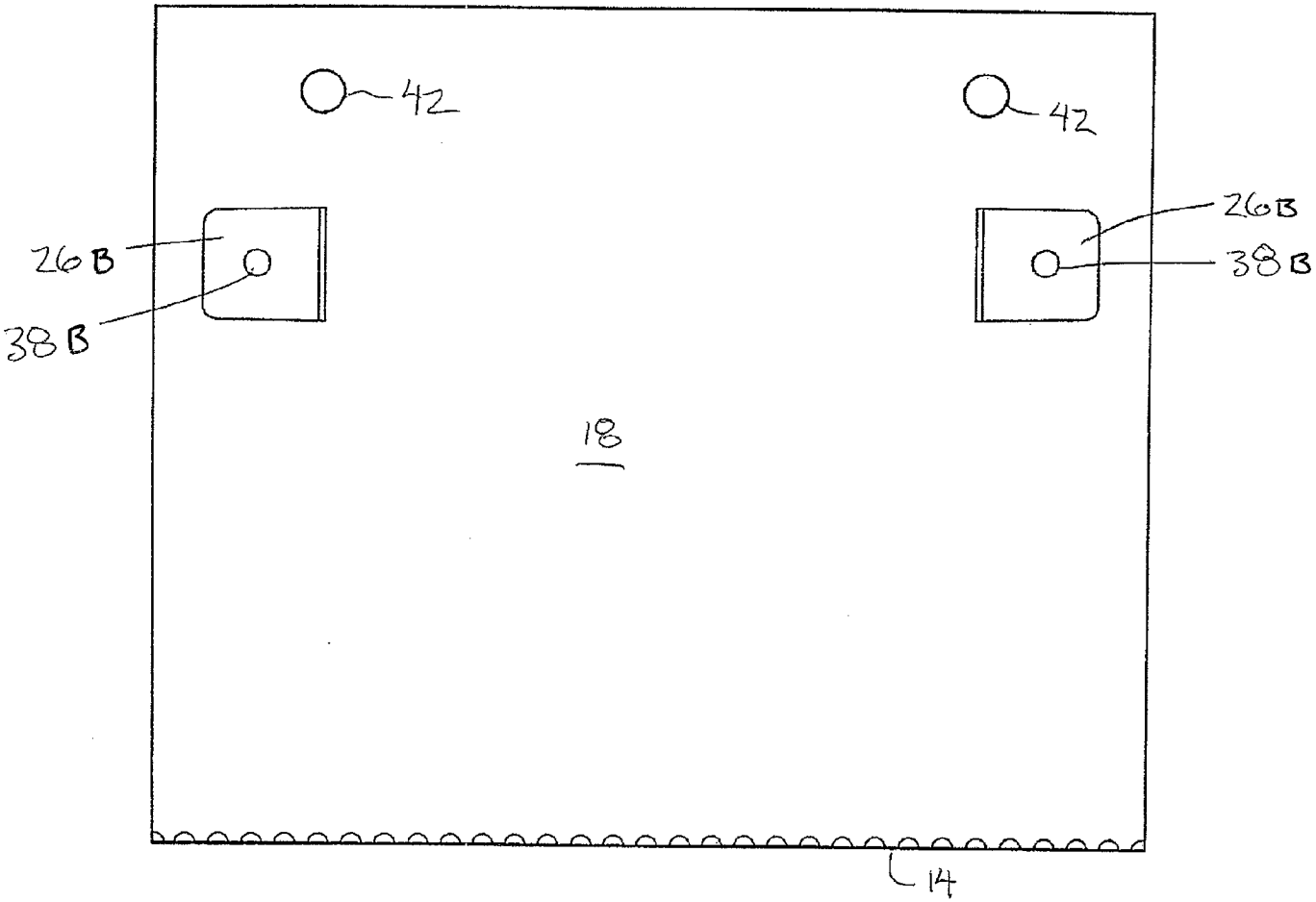
FIG. 4 is a rear elevational view of the sheet metal receptacle.

Referring to the accompanying figures there is illustrated a sheet metal receptacle generally indicated by reference numeral 10. The receptacle 10 is formed from a single blank 12 of sheet metal which has been cut and punched into the desired configuration for assembly into the receptacle. The blank shown in FIG. 2 can be readily folded by a consumer without tools. Different portions of the folded blank can be joined to one another by integral interlocking connections so that no additional fasteners are required and such that no tools are required by the consumer for joining the different portions of the blank to form the receptacle 10.

The blank 12 generally includes a floor panel portion 14 defining a floor of the receptacle, a front panel portion 16 defining an upright front wall at a front side of the receptacle, a rear panel portion 18 defining an upright rear wall at a rear side of the receptacle, and two side panel portions 20 defining side walls at respective laterally opposed sides of the receptacle in which all of the panel portions are integrally and seamlessly joined with one another. The front panel portion, the rear panel portion and the two side panel portions are joined to respective front, rear and two side edges of the floor panel portion along respective primary folding lines of weakness in the sheet metal blank. Each primary folding line of weakness is formed by a single aligned row of perforations 22 in the sheet metal blank.

The perforations in the illustrated embodiment comprise round apertures of equal diameter. The center to center distance along the respective fold line between adjacent apertures is less than 150% of the diameter of the apertures. Accordingly the width along the fold line which is occupied by sheet metal between the outer edges of each adjacent pair of apertures is less than the radius of one of the apertures.

The floor panel portion 14 defining the floor of the receptacle includes a front edge and a rear edge along longitudinally opposed front and rear ends, and two side edges extending along laterally opposing sides of the floor panel portion between the front and rear edges so as to be generally square in shape.

The front panel portion 16 is generally rectangular and is shorter in height from an inner edge joined along the front edge of the floor panel portion to an opposing outer edge than it is in width between opposing side edges. The front panel portion spans the same lateral width between the sides thereof as the floor panel portion.

The rear panel portion 18 is also generally rectangular. It is taller in height from an inner edge joined along the rear edge of the floor panel portion to an opposing outer edge than the height of the front panel portion. The height is near to, but slightly less than the width between opposing side edges which similarly corresponds to the same lateral width between respective side edges as the floor panel portion.

The side panel portions 20 are joined longitudinally at respective inner edges along the full length of the side edges of the floor panel portion 14 to be similar in length from front to rear edges as the floor panel portion. Height of the front edge of each side panel portion 20 between the inner edge and a corresponding opposing outer edge of the panel is substantially equal to the height of the front panel portion 16. Similarly height of the rear edge of each side panel portion 20 between the inner edge and a corresponding opposing outer edge of the panel is substantially equal to the height of the rear panel portion. Accordingly the top outer edge of each side panel portion includes a sloped portion 23 which extends forwardly at a downward inclination In an assembled position of the receptacle, the opposing front and rear edges of the side panel portions are vertically oriented alongside respective side edges from the front and rear panel portions to form the four corners of the rectangular shape of the receptacle.

A pair of front interlocking connections are arranged to connect opposing sides of the front panel portion 16 to respective ones of the side panel portions 20 and retain the connection in the assembled position. Similarly a pair of rear interlocking connections are arranged to connect opposing sides of the rear panel portion 18 to respective ones of the side panel portions 20 and retain the connection in the assembled position.

Each front interlocking connection includes a front mounting tongue 24A integrally formed on the front panel portion 20. The tongues are generally centered between inner and outer edges of the front panel portion adjacent the opposing sides respectively. Each tongue is formed by a U-shaped cut in the panel portion so that the tongue is anchor at one end closest to the other tongue and such that the tongue extends laterally outwardly away from the other tongue towards the respective side edge of the front panel portion. A main body of the tongue is generally parallel to the front panel portion with sufficient space therebetween to receive a thickness of the sheet metal blank therebetween as described in further detail below. A free end portion 25 of the tongue is bent to be inclined away from the panel portion towards the free end for ease of insertion of a corresponding mating part also described in further detail below.

Each front interlocking connection also includes a front mounting tab 26A integrally joined at an inner edge to the respective side edge of the respective side panel portion 20. Each mounting tab is joined to the respective panel portion along a respective secondary folding line of weakness in the sheet metal blank. Each second folding line of weakness is formed by a row of perforations 22 in the sheet metal blank identical to the primary folding lines described above so that the mounting tab is readily foldable relative to respective panel portion with which it is integrally and seamless formed.

Each front mounting tab 26A further includes a first portion 28 and a second portion 30. The first portion 28 protrudes from the inner edge of the tab to a first outer edge 32 by a distance corresponding to a distance of the anchored end of the respective tongue from the side edge of the front panel portion. The first portion 28 is thus arranged to be received between the front mounting tongue 24A and the front panel portion 16 with the first outer edge 32 substantially abutting where the tongue is anchored to the front panel portion in the assembled position.

The second portion 30 is rigid and coplanar with the first portion 28. The second portion protrudes from the inner edge of the tab to a second outer edge 34 which is spaced from the inner edge by a greater distance than the first outer edge. The outer edge of the overall tab is thus stepped in profile. The second portion 30 is above the first portion 28 in the assembled position by forming each mounting tab such that the second portion is farther from the floor panel portion than the respective first portion. A top edge of each second portion 30 in the assembled position is substantially flush with the top edge of the front panel portion.

Each front interlocking connection also includes a first front connector 36A formed integrally on the front mounting tongue which is in turn formed integrally on the front panel portion 16. A corresponding second front connector 38A is formed on the first portion of the front mounting tab so as to be arranged to matingly connect with the first front connector 36A in the assembled position. In this instance the respective side panel portion is joined to the front panel portion solely by mating connection of the first and second front connectors.

More particularly, the second front connector 38A comprises an aperture formed in the first portion at a location spaced inwardly from the first inner edge. The first front connector 36A is a protrusion which is partially punched through the sheet metal blank at a central location within the tongue to remain anchored thereto while defining a retaining edge facing inwardly towards the other front connector. A corresponding edge of the aperture defining the second front connector 38A is arranged to be engaged upon and retained on the retaining edge of the first front connector in the assembled position. The tongue is sufficiently resilient so that upon insertion of the mounting tab between the tongue and front panel portion, the tongue is deflected outwardly to accommodate the protrusion of the first front connector 36A until it is aligned with the aperture of the second front connector. The resilient of the tongue biases the protrusion to remain engaged in the aperture to resist sliding removal of the mounting tab from the interlocking connection.

Two rear interlocking connections are arranged substantially identically to the front interlocking connections described above to connect opposing sides of the rear panel portion to respective ones of the side panel portions. Each rear interlocking connection thus includes a rear mounting tongue 24B integrally formed on the rear panel portion 18, a first rear connector 36B formed on the rear mounting tongue, a rear mounting tab 26B integrally joined to the respective side panel portion so as to include a first portion 28 with a first outer edge 32 and a second portion 30 with a second outer edge 34, and a second rear connector 38B formed on the first portion of the rear mounting tab. The second rear connector 38B matingly connects with the first rear connector 36B such that the respective side panel portion is joined to the rear panel portion solely by mating connection of the first and second rear connectors. The rear mounting tongues 24B differ from the front mounting tongues only in that they are not centered along the height of the rear panel portion, but rather are nearer to the top outer edge of the rear panel portion so that the top edge of the mounting tabs are flush with the top outer edge of the rear panel portion in the assembled position similar to the front mounting tabs relative to the top outer edge of the front panel portion.

An auxiliary mounting aperture 40 is formed in the second portion of each front and rear mounting tab. The auxiliary mounting apertures are arranged to be aligned in the assembled position with respective ones of two rear mounting apertures 42 formed in the rear panel portion and two front mounting apertures 44 formed in the front panel portion. The rear mounting apertures 42 are formed in the rear panel portion at laterally spaced positions adjacent the outer or top edge opposite from the inner edge joined to the floor panel portion. The mounting apertures remain separate and spaced apart from respective ones of the first and second connectors of the respective interlocking connection. The apertures can be used to receive additional fasteners therethrough if desired for extra strength, though generally this is not required.

Figure 7:
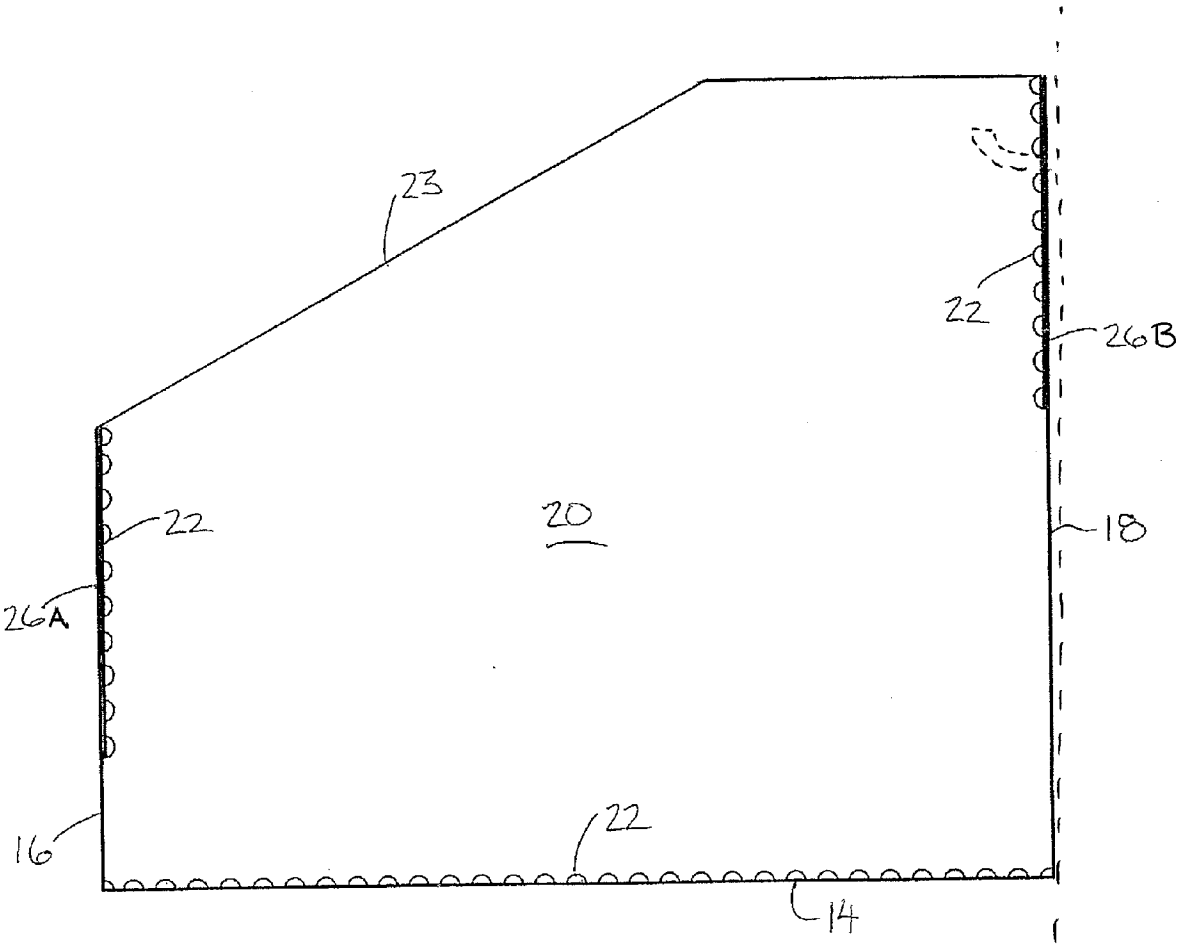
FIG. 7 is a right side elevational view of the sheet metal receptacle.
Figure 8:
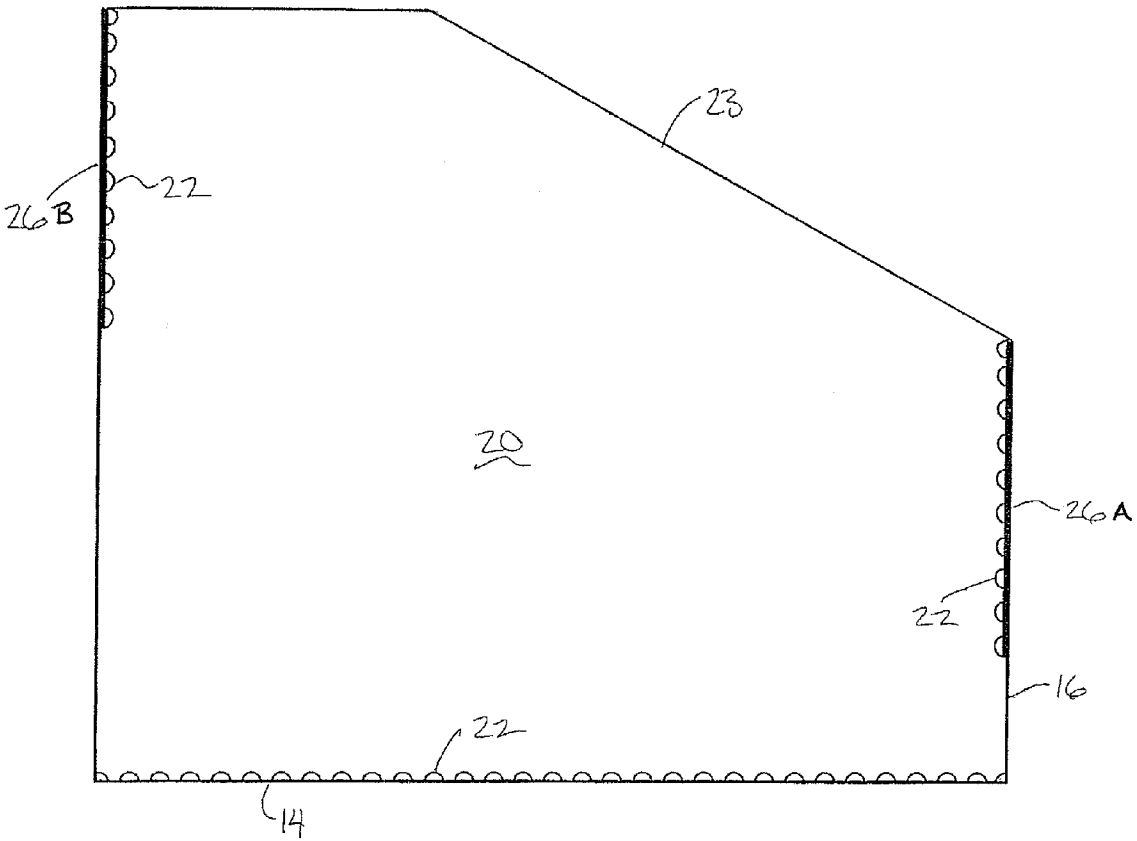
FIG. 8 is a left side elevational view of the sheet metal receptacle.

The receptacle is well suited for mounting or being hung on an upright supporting surface using a pair of hanging elements. In one example shown in broken line in FIG. 7, the upright supporting surface comprises a peg-board and the hanging elements are hook members which include a first portion hooked into respective apertures in the peg-board and a second portion protruding outwardly and upwardly so as to be arranged to hook a respective rear mounting aperture and corresponding auxiliary mounting aperture thereon.

Figure 5:
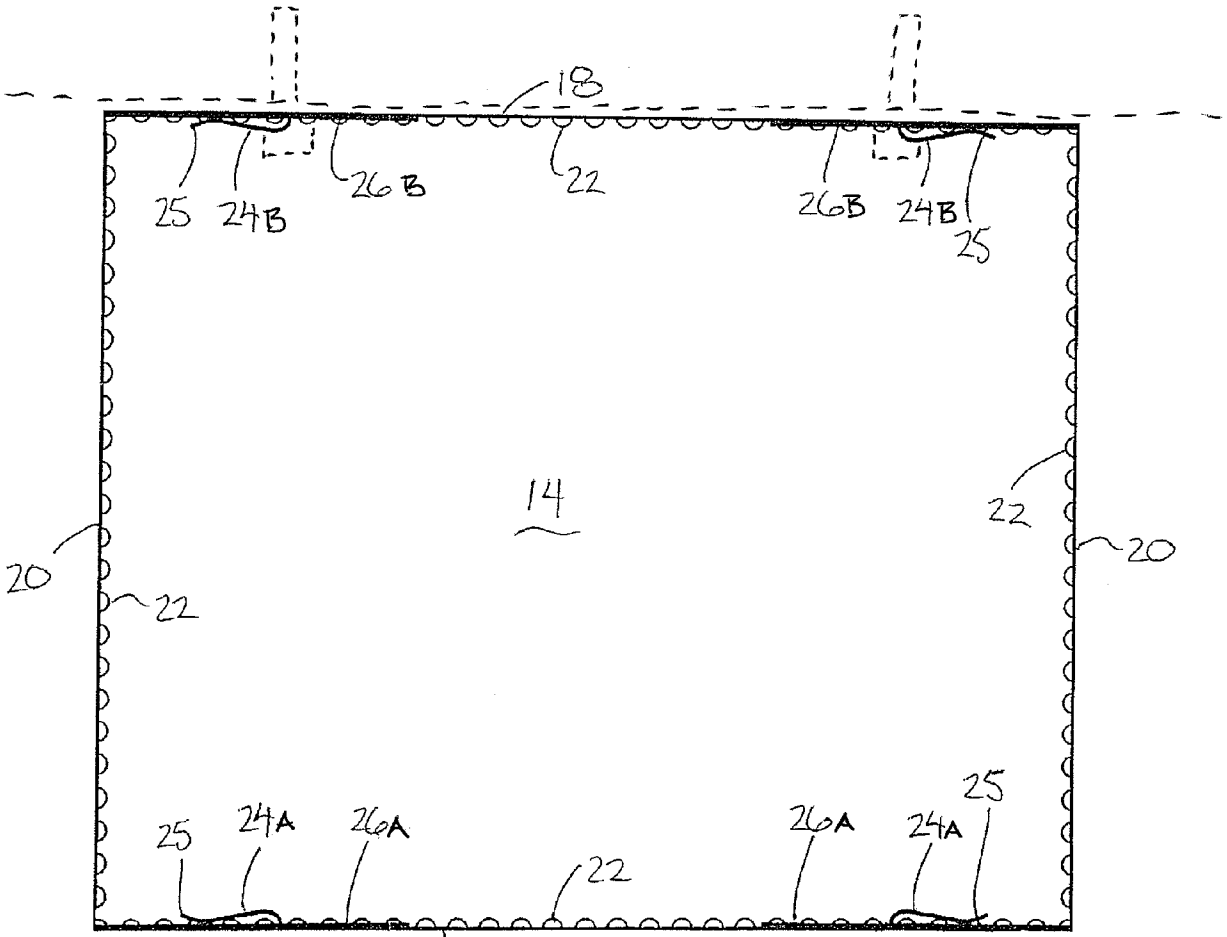
FIG. 5 is a top plan view of the sheet metal receptacle.
Figure 6:
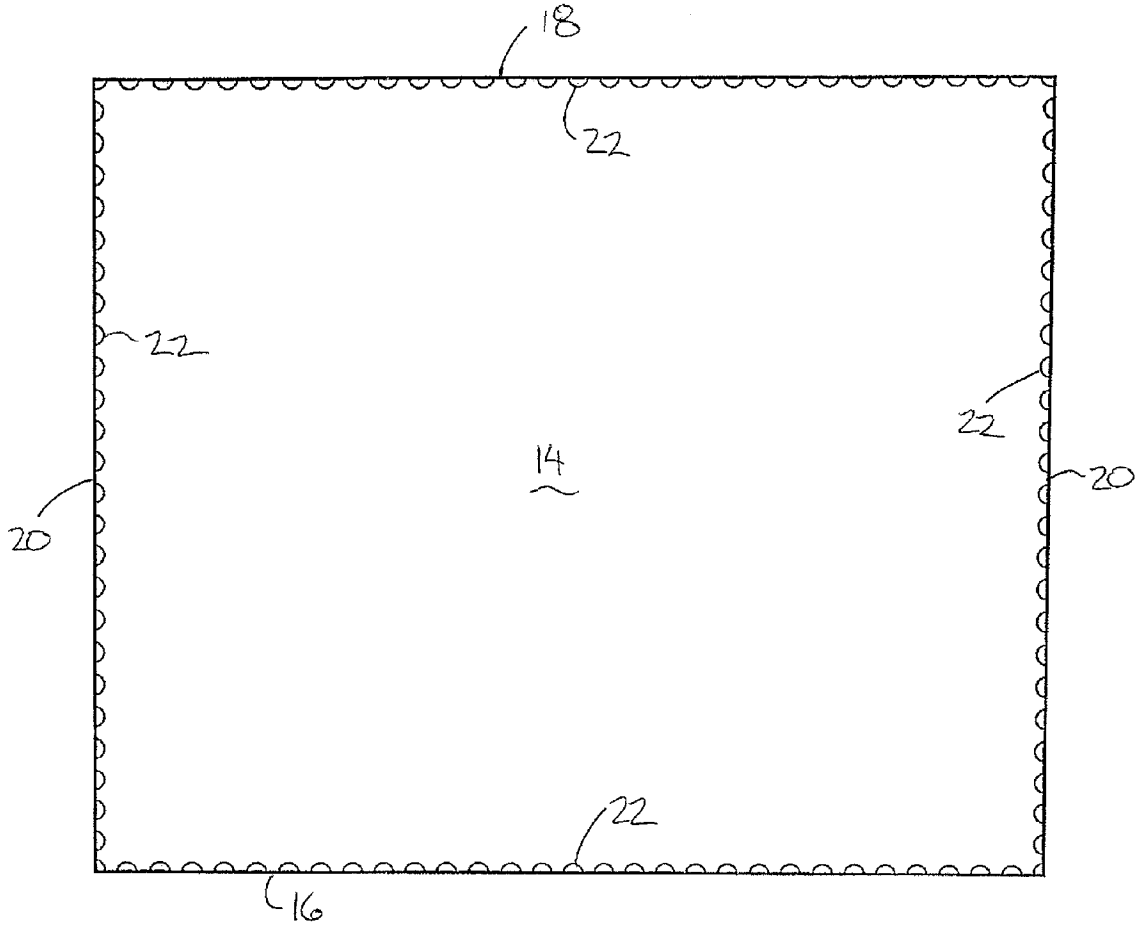
FIG. 6 is a bottom view of the sheet metal receptacle.

Alternatively the hanging elements may comprise threaded fasteners for being threaded through the respective apertures and into the upright supporting surface which may be a frame or a wall for example as shown in broken line in FIG. 5.

In use, each blank can be readily folded into the assembled receptacle by a consumer of the product without any special tools being required.

In the illustrated embodiment the tongues 24 are formed to protrude from a common first side of the flat plane of the blank 12 and the panels are then folded inwardly towards one another so that the common first side of the blank forms interior surfaces of the resulting walls of the receptacle. The tongues 24 thus protrude inwardly from the inner surfaces of the walls of the receptacle. Each mountings tab in this instance is accordingly folded and positioned along the inner surface of the panel locating the corresponding tongue thereon to be arranged for mating engagement of the corresponding first and second connectors at the inner surface.

In an alternative configuration, the same blank 12 can instead be folded so that the common first side of the blank instead forms the outer surfaces of the resulting walls of the receptacle. In this instance, the tongues 24 instead protrude outwardly from the outer surfaces to the exterior of the receptacle. Each mounting tab in this instance is accordingly folded and positioned along the outer surface of the panel locating the corresponding tongue thereon to be arranged for mating engagement of the corresponding first and second connectors at the outer surface. This alternative configuration can result in further increased strength of the interlocking connection when used for hanging through the rear apertures and auxiliary apertures in the mounting tabs at the rear panel. In yet a further embodiment, alternative mounting locations for the first front and rear connectors and the front and rear mounting tabs as described above in the summary section are represented schematically in broken line in FIG. 2.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A sheet metal blank arranged to form a receptacle for securement to a pair hanging elements on an upright supporting surface, the sheet metal blank comprising:

a floor panel portion arranged to define a floor of the receptacle and including a front edge, a rear edge, and two side edges extending along opposing sides of the floor panel portion between the front and rear edges;

a front panel portion integrally joined along the front edge of the floor panel portion so as to be foldable relative to the floor panel portion and as so as to define an upright front wall of the receptacle;

a rear panel portion integrally joined at an inner edge along the rear edge of the floor panel portion so as to be foldable relative to the floor panel portion and so as to define an upright rear wall of the receptacle;

a pair of side panel portions integrally joined along the side edges of the floor panel portion respectively so as to be foldable relative to the floor panel portion and so as to define respective upright side walls of the receptacle;

a pair of front interlocking connections arranged to connect opposing sides of the front panel portion to respective ones of the side panel portions, each front interlocking connection comprising:

a first front connector integrally formed on one of the front panel portion or the respective side panel portion; and a front mounting tab integrally joined to the other one of the front panel portion or the respective side panel portion so as to be foldable in relation thereto; and a second front connector formed on the front mounting tab which is arranged to matingly connect with the first front connector such that the respective side panel portion is joined to the front panel portion solely by mating connection of the first and second front connectors;

a pair of rear interlocking connections arranged to connect opposing sides of the rear panel portion to respective ones of the side panel portions, each rear interlocking connection comprising:

a first rear connector integrally formed on the rear panel portion;

a rear mounting tab integrally joined to the respective side panel portion so as to be foldable in relation thereto; and a second rear connector formed on the rear mounting tab which is arranged to matingly connect with the first rear connector such that the respective side panel portion is joined to the rear panel portion solely by mating connection of the first and second rear connectors;

an auxiliary mounting aperture formed in each rear mounting tab; and a pair of rear mounting apertures formed in the rear panel portion adjacent an outer edge opposite from the inner edge such that:

the rear mounting apertures are aligned with respective ones of the auxiliary mounting apertures in the rear mounting tabs;

the rear mounting apertures are spaced apart from the first and second rear connectors of the respective rear interlocking connection; and each rear mounting aperture and the auxiliary mounting aperture aligned therewith are arranged to receive a respective one of the hanging elements therethrough;

wherein each front mounting tab comprises a first portion protruding from the inner edge to a first outer edge and which locates the second front connector therein and a second portion in rigid coplanar relationship with the first portion which protrudes from the inner edge to a second outer edge which is spaced from the inner edge by a greater distance than the first outer edge; and wherein each rear mounting tab comprises a first portion protruding from the inner edge to a first outer edge and which locates the second rear connector therein and a second portion in rigid coplanar relationship with the first portion which protrudes from the inner edge to a second outer edge which is spaced from the inner edge by a greater distance than the first outer edge.

2. The sheet metal blank according to claim 1 wherein each front interlocking connection further comprises a front mounting tongue integrally formed on one of the front panel portion or the respective side panel portion such that the first front connector is formed on the front mounting tongue and such that a portion of the front mounting tab is arranged to be received between the front mounting tongue and the front panel portion or the respective side panel portion upon which the front mounting tongue is integrally formed when the first and second front connectors are mated, and each rear interlocking connection further comprises a rear mounting tongue integrally formed on one of the rear panel portion or the respective side panel portion such that the first rear connector is formed on the rear mounting tongue and such that a portion of the rear mounting tab is arranged to be received between the rear mounting tongue and the rear panel portion or the respective side panel portion upon which the rear mounting tongue is integrally formed when the first and second rear connectors are mated.

3. The sheet metal blank according to claim 1 wherein the front panel portion, the rear panel portion and the side panel portions are each joined to the floor panel portion along a respective primary folding line of weakness in the sheet metal blank and each mounting tab is joined to the respective panel portion along a respective secondary folding line of weakness in the sheet metal blank, each of the primary and second folding lines of weakness comprising a row of perforations in the sheet metal blank.

4. The sheet metal blank according to claim 1 wherein each mounting tab is formed such that the second portion is farther from the floor panel portion than the respective first portion so as to be located above the first portion.

5. The sheet metal blank according to claim 1 in combination with the hanging elements in which each hanging element comprises a hook member protruding outwardly and upwardly from the upright supporting surface so as to be received through a respective one of the rear mounting apertures and retain the receptacle thereon.

6. The sheet metal blank according to claim 1 in combination with the hanging elements in which each hanging element comprises a fastener received through a respective one of the rear mounting apertures and fastened to the upright supporting surface so as to retain the receptacle thereon.

7. A sheet metal blank arranged to form a receptacle, the sheet metal blank comprising:

a floor panel portion arranged to define a floor of the receptacle and includes a front edge, a rear edge, and two side edges extending along opposing sides of the floor panel portion between the front and rear edges;

a front panel portion integrally joined along the front edge of the floor panel portion so as to be foldable relative to the floor panel portion and as so as to define an upright front wall of the receptacle;

a rear panel portion integrally joined at an inner edge along the rear edge of the floor panel portion so as to be foldable relative to the floor panel portion and so as to define an upright rear wall of the receptacle;

a pair of side panel portions integrally joined along the side edges of the floor panel portion respectively so as to be foldable relative to the floor panel portion and so as to define respective upright side walls of the receptacle;

a pair of front interlocking connections arranged to connect opposing sides of the front panel portion to respective ones of the side panel portions, each front interlocking connection comprising:

a front mounting tongue integrally formed on one of the front panel portion or the respective side panel portion;

a first front connector formed on the front mounting tongue;

a front mounting tab integrally joined at an inner edge to the other one of the front panel portion or the respective side panel portion so as to be foldable in relation thereto, the front mounting tab including:

a first portion protruding from the inner edge to a first outer edge arranged to be received between the front mounting tongue and the panel portion upon which the front mounting tongue is integrally formed; and a second portion in rigid coplanar relationship with the first portion which protrudes from the inner edge to a second outer edge which is spaced from the inner edge by a greater distance than the first outer edge;

a second front connector formed on the first portion of the front mounting tab which is arranged to matingly connect with the first front connector such that the respective side panel portion is joined to the front panel portion solely by mating connection of the first and second front connectors; and a pair of rear interlocking connections arranged to connect opposing sides of the rear panel portion to respective ones of the side panel portions, each rear interlocking connection comprising:

a rear mounting tongue integrally formed on one of the rear panel portion or the respective side panel portion;

a first rear connector formed on the rear mounting tongue;

a rear mounting tab integrally joined at an inner edge to the other one of the rear panel portion or the respective side panel portion so as to be foldable in relation thereto, the rear mounting tab including:

a first portion protruding from the inner edge to a first outer edge arranged to be received between the rear mounting tongue and the panel portion upon which the rear mounting tongue is integrally formed; and a second portion in rigid coplanar relationship with the first portion which protrudes from the inner edge to a second outer edge which is spaced from the inner edge by a greater distance than the first outer edge; and a second rear connector formed on the first portion of the rear mounting tab which is arranged to matingly connect with the first rear connector such that the respective side panel portion is joined to the rear panel portion solely by mating connection of the first and second rear connectors.

8. The sheet metal blank according to claim 7 wherein each mounting tab is formed such that the second portion is farther from the floor panel portion than the respective first portion so as to be located above the first portion.

* * * * *